US011337482B2

(12) United States Patent
Tan et al.

(10) Patent No.: US 11,337,482 B2
(45) Date of Patent: May 24, 2022

(54) CHINBAR ATTACHMENT SYSTEMS AND METHODS

(71) Applicant: 100% SPEEDLAB, LLC, San Diego, CA (US)

(72) Inventors: Dennis C. Tan, San Diego, CA (US); Michael D. Young, San Diego, CA (US)

(73) Assignee: 100% Speedlab, LLC, San Diego, CA (US)

( * ) Notice: Subject to any disclaimer, the term of this patent is extended or adjusted under 35 U.S.C. 154(b) by 289 days.

(21) Appl. No.: 16/525,299

(22) Filed: Jul. 29, 2019

(65) Prior Publication Data

US 2019/0350300 A1 Nov. 21, 2019

Related U.S. Application Data

(63) Continuation of application No. PCT/US2019/020434, filed on Mar. 1, 2019.

(60) Provisional application No. 62/638,031, filed on Mar. 2, 2018.

(51) Int. Cl.
*A42B 3/20* (2006.01)

(52) U.S. Cl.
CPC ..... *A42B 3/205* (2013.01)

(58) Field of Classification Search
CPC ..... A42B 3/205; A42B 3/063; A42B 3/065; A42B 3/08; A42B 3/10; A42B 3/18; A42B 3/20; A42B 3/326; F41H 1/04
USPC ..... 2/410, 424, 425
See application file for complete search history.

(56) References Cited

U.S. PATENT DOCUMENTS

| | | | | |
|---|---|---|---|---|
| 3,216,023 | A * | 11/1965 | Morgan | A42B 3/08 2/9 |
| 5,619,755 | A | 4/1997 | Casartelli | |
| 10,492,559 | B1 * | 12/2019 | Kele | A42B 3/326 |
| 11,026,467 | B2 * | 6/2021 | Durham | A42B 3/125 |
| 2014/0338106 | A1 | 11/2014 | Zanchi | |
| 2017/0112227 | A1 * | 4/2017 | Pietrzak | A42B 3/326 |

FOREIGN PATENT DOCUMENTS

| | | |
|---|---|---|
| EP | 0476591 | 3/1992 |
| WO | WO2017/159905 | 9/2017 |

* cited by examiner

*Primary Examiner* — Katherine M Moran
(74) *Attorney, Agent, or Firm* — Kolitch Romano LLP

(57) ABSTRACT

A helmet assembly may include a helmet and an integrated chinbar. The chinbar may include an attachment portion and the helmet may include a docking frame. Coupling together of the attachment portion to the docking frame may couple the chinbar to the helmet. The attachment portion may then be secured to docking frame to secure the chinbar to the helmet. In certain embodiments, the attachment portion may be coupled to the docking frame of an interior side of the liner. Thus, the attachment portion may accordingly be disposed on the side of the liner closer to a wearer's face.

23 Claims, 15 Drawing Sheets

CHINBAR ATTACHMENT SYSTEMS AND METHODS

CROSS-REFERENCE TO RELATED APPLICATIONS

This application is a continuation of International Patent Application No. PCT/US2019/020434 filed Mar. 1, 2019 and entitled "CHINBAR ATTACHMENT SYSTEMS AND METHODS," the contents of which are incorporated herein by reference in its entirety.

International Patent Application No. PCT/US2019/020434 claims the benefit of and priority to U.S. Provisional Patent Application No. 62/638,031 filed Mar. 2, 2018 and entitled "CHINBAR ATTACHMENT SYSTEMS AND METHODS," the contents of which are incorporated herein by reference in its entirety.

TECHNICAL FIELD

One or more embodiments relate generally to helmets and, more particularly, to helmets with integrated chinbars.

BACKGROUND

Helmets are worn for various sports or activities, such as motorsports, powersports, snowsports, watersports, biking, or the like, to protect wearers' heads, for example, by absorbing impacts. Styles of helmets may include closed helmets and open faced helmets. A closed helmet may include a chin portion that may protect a wearer's chin or other portions of a wearer's lower face, while an open helmet may not include chin protection and may expose the wearer's lower face.

SUMMARY

Systems and methods are provided in accordance with one or more embodiments directed to helmet assemblies that include a helmet with a chinbar. The chinbar may be coupled to the helmet to improve a user's facial protection. In an embodiment, a helmet assembly may be provided having a helmet and a chinbar that includes an attachment portion. The helmet may include an outer shell, a liner coupled to the outer shell on a first side and configured to receive a user's head on a second side, and a docking frame coupled to the liner and configured to receive the attachment portion to couple the helmet to the chinbar.

In certain embodiments, the docking frame is coupled to the liner on the second side.

In certain embodiments, the liner includes a channel and the attachment portion includes a finger configured to extend into the channel to couple to the docking frame. In such certain embodiments, at least a portion of the docking frame is disposed within the channel. In certain such embodiments, the docking frame includes an attachment post disposed within the channel and the finger includes an opening configured to couple to the attachment post.

In certain embodiments, the docking frame includes a positioning post disposed in a substantially forward facing position, and the chinbar comprises an opening configured to couple to the positioning post.

In certain embodiments, the docking frame includes a molded cage.

In certain embodiments, the helmet assembly further includes a rivet coupling the attachment portion to the docking frame.

In certain embodiments, the chinbar further includes a flange configured to be disposed on a first side of the outer shell and the liner is coupled to the outer shell on a second side of the outer shell.

In certain embodiments, the liner is disposed between the outer shell and at least a portion of the docking frame.

In certain embodiments, a method of using the helmet assembly may be provided, the method including disposing at least a portion of the attachment portion proximate the docking frame and coupling the attachment portion to the docking frame. In certain such embodiments, the coupling the attachment portion to the docking frame includes riveting the attachment portion to the docking frame.

In another embodiment, a helmet may be provided having an outer shell, a liner coupled to the outer shell on a first side and configured to receive a user's head on a second side, and a docking frame coupled to the liner and configured to receive an attachment portion to couple the helmet to a chinbar.

In certain embodiments, the docking frame is coupled to the liner on the second side.

In certain embodiments, the liner includes a channel configured to receive an attachment portion of a chinbar. In certain such embodiments, at least a portion of the docking frame is disposed within the channel. In certain such embodiments, the docking frame includes an attachment post disposed within the channel configured to receive an opening of the attachment portion of the chinbar.

In certain embodiments, the docking frame includes a positioning post disposed in a substantially forward facing position and configured to couple to a chinbar.

In certain embodiments, the docking frame includes a molded cage.

In certain embodiments, the liner is disposed between the outer shell and at least a portion of the docking frame.

A more complete understanding of embodiments of the invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the invention and their advantages are best understood by referring to the detailed description that follows. It should be appreciated that like reference numerals are used to identify like elements illustrated in one or more of the Figures.

DETAILED DESCRIPTION

Helmet assemblies that include an integrated chinbar, as well as components of the helmet assembly, are described herein. "Helmet assembly" may refer to a helmet and a chinbar, either separately or in combination. The systems and techniques described herein may allow for easy assembly of the chinbar to the helmet during manufacture and improve the manufacturing process for helmets with integrated chinbars.

The helmet assemblies described herein may include a helmet and a chinbar. The chinbar may include an attachment portion for coupling the chinbar to the helmet. The helmet may include an outer shell, a liner, and a docking frame. The liner may be coupled to the outer shell on a first side and configured to receive a wearer's head on a second side. The docking frame may be coupled to the liner and configured to receive the attachment portion of the chinbar to couple the helmet to the chinbar. Various structures and techniques described herein may couple the chinbar to the helmet.

Figure 1A:
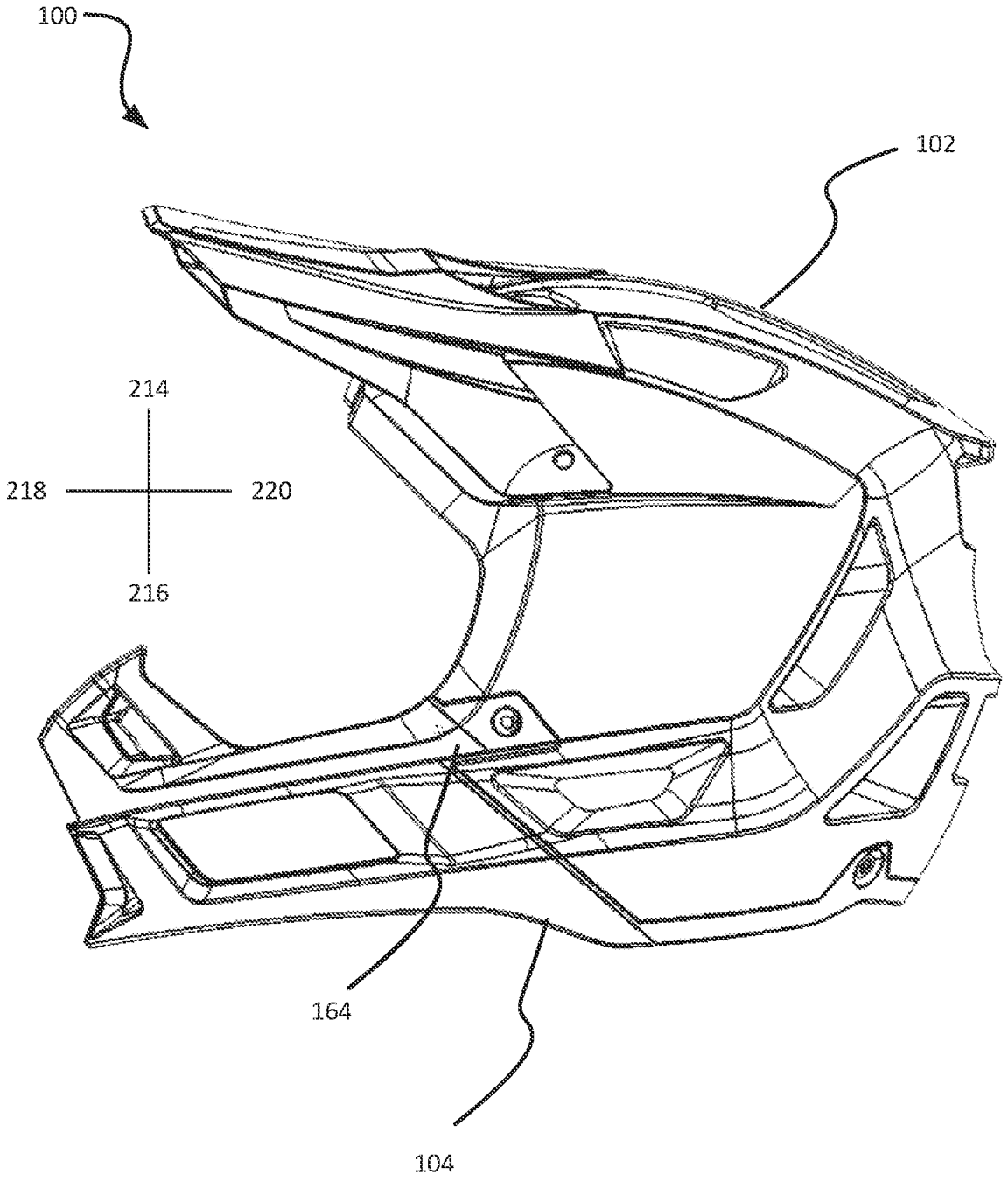
FIG. 1A shows a side view of a helmet assembly, in accordance with an embodiment.

FIG. 1A shows a side view of a helmet assembly 100, in accordance with an embodiment of the disclosure. Helmet assembly 100 may include a helmet 102 and a chinbar 104. As described herein, the chinbar 104 may be a separate element that is coupled to helmet 102. When chinbar 104 is coupled to helmet 102, chinbar 104 may cover a lower part of a wearer's face (e.g., the wearer's mouth, chin, jaw, nose, or a portion thereof of one or more of the mouth, chin, jaw, and nose). The helmet assembly 100 may include other features or elements, such as those conventional in the art. For example, the helmet assembly 100 may include a visor to protect, such as shading, an upper part of the wearer's face (e.g., the wearer's eyes, forehead, or a portion thereof).

Figure 1B:
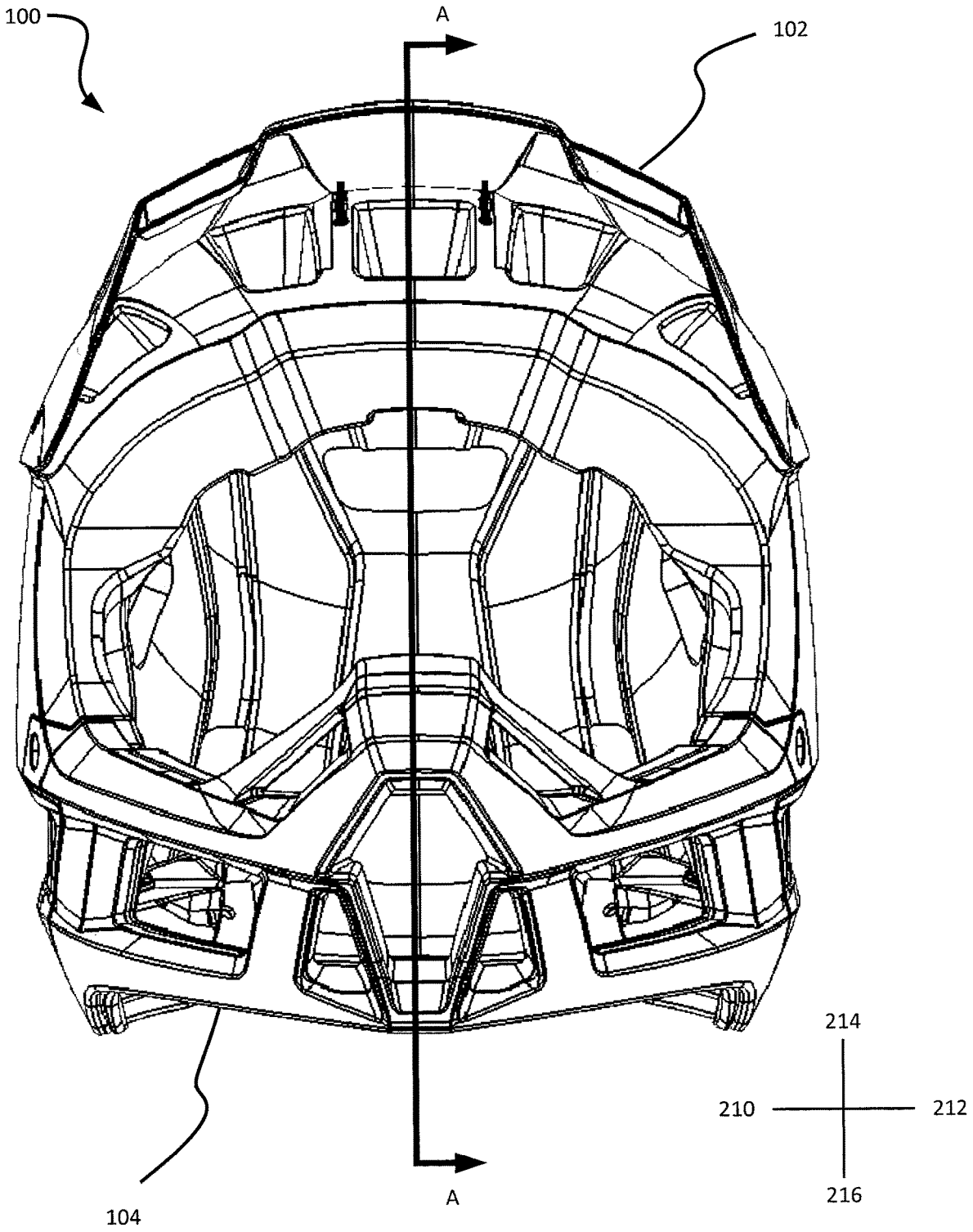
FIG. 1B shows a front view of the helmet assembly of FIG. 1A, in accordance with an embodiment.
Figure 2:
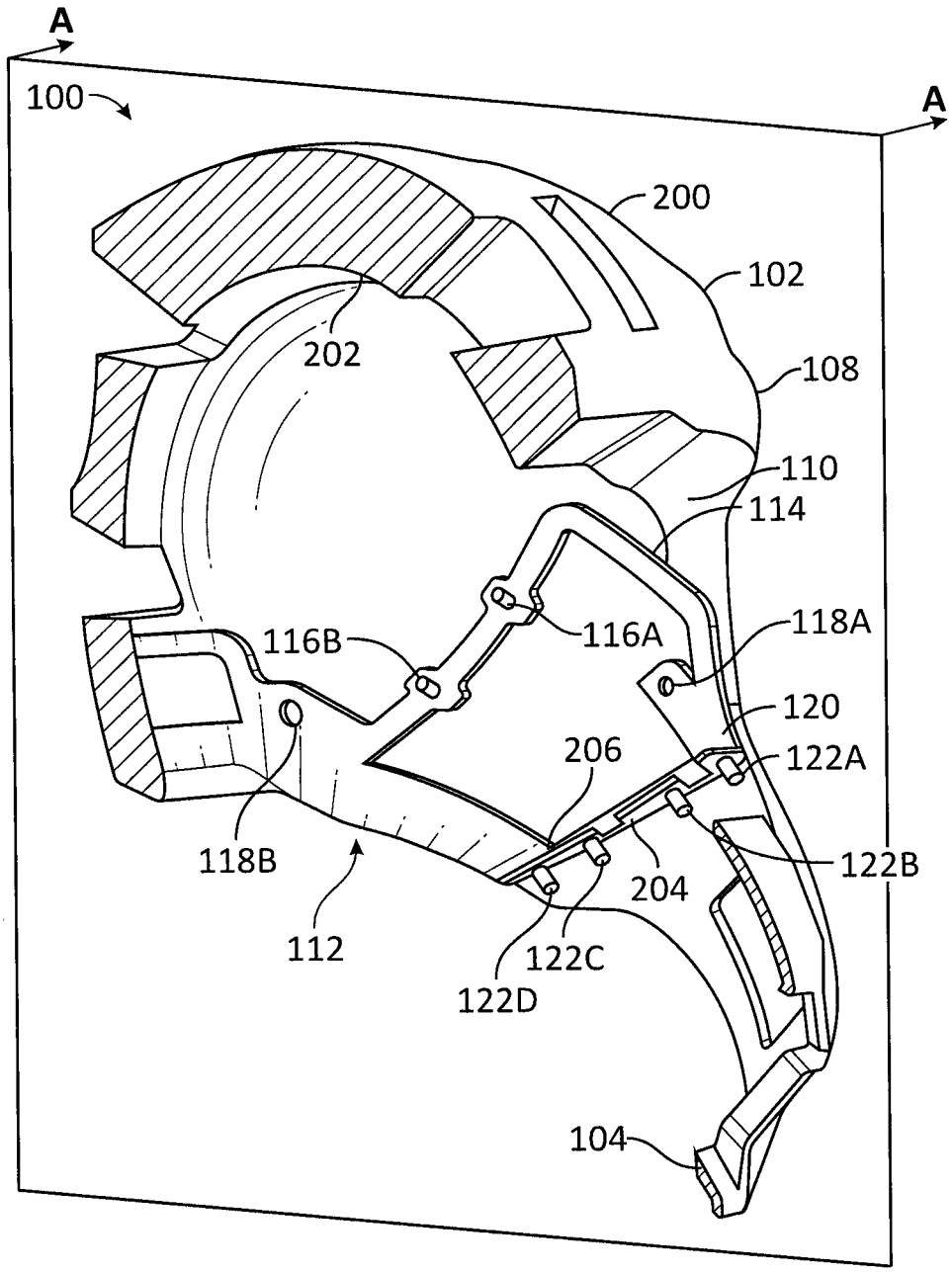
FIG. 2 shows a perspective cross-sectional view of the helmet assembly of FIGS. 1A and 1B along section A-A with select portions of the helmet assembly removed for illustration purposes, in accordance with an embodiment.
Figure 3:
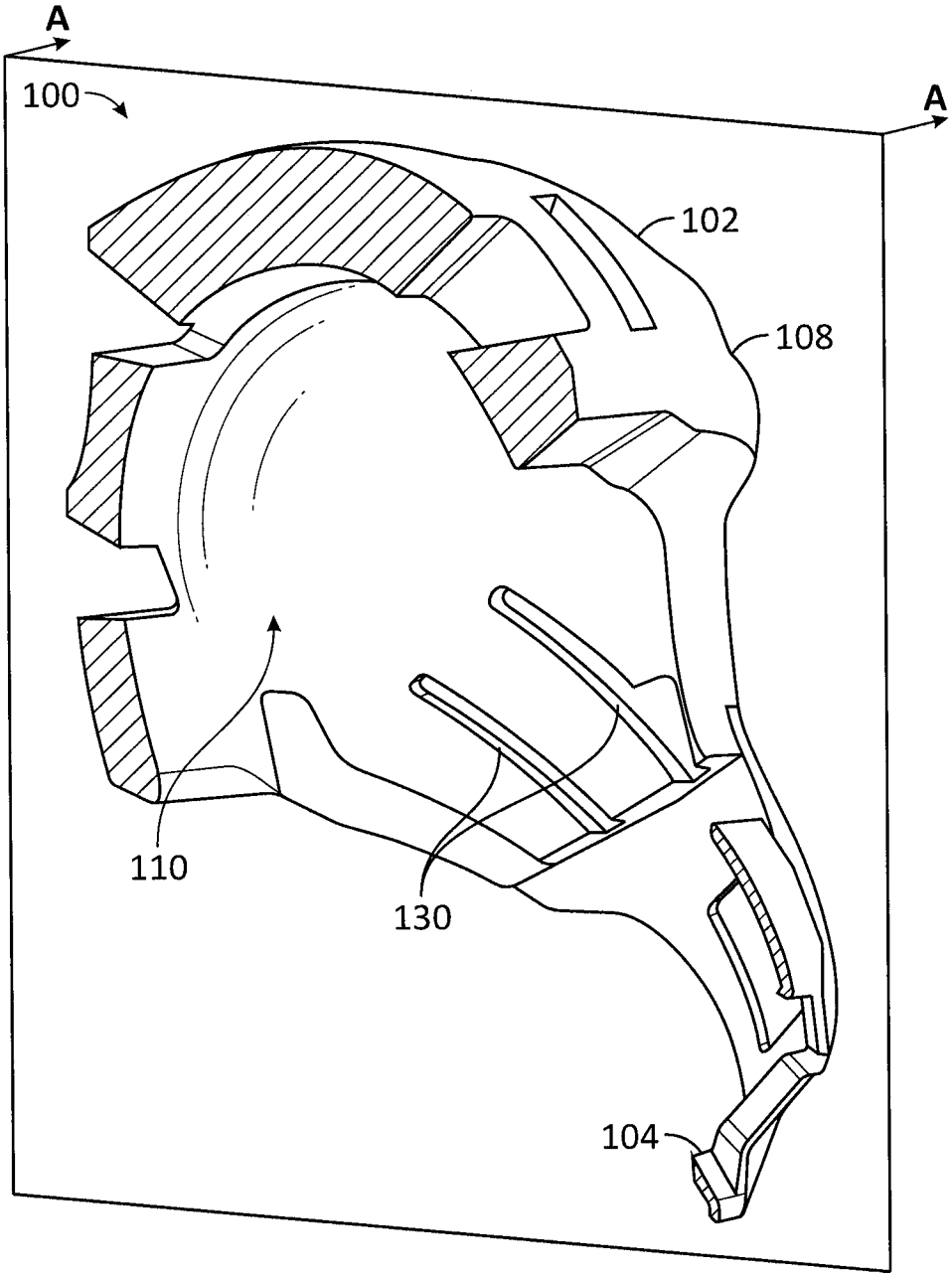
FIG. 3 shows another perspective cross-sectional view of the helmet assembly of FIGS. 1A and 1B along section A-A with select portions of the helmet assembly removed for illustration purposes, in accordance with an embodiment.
Figure 4:
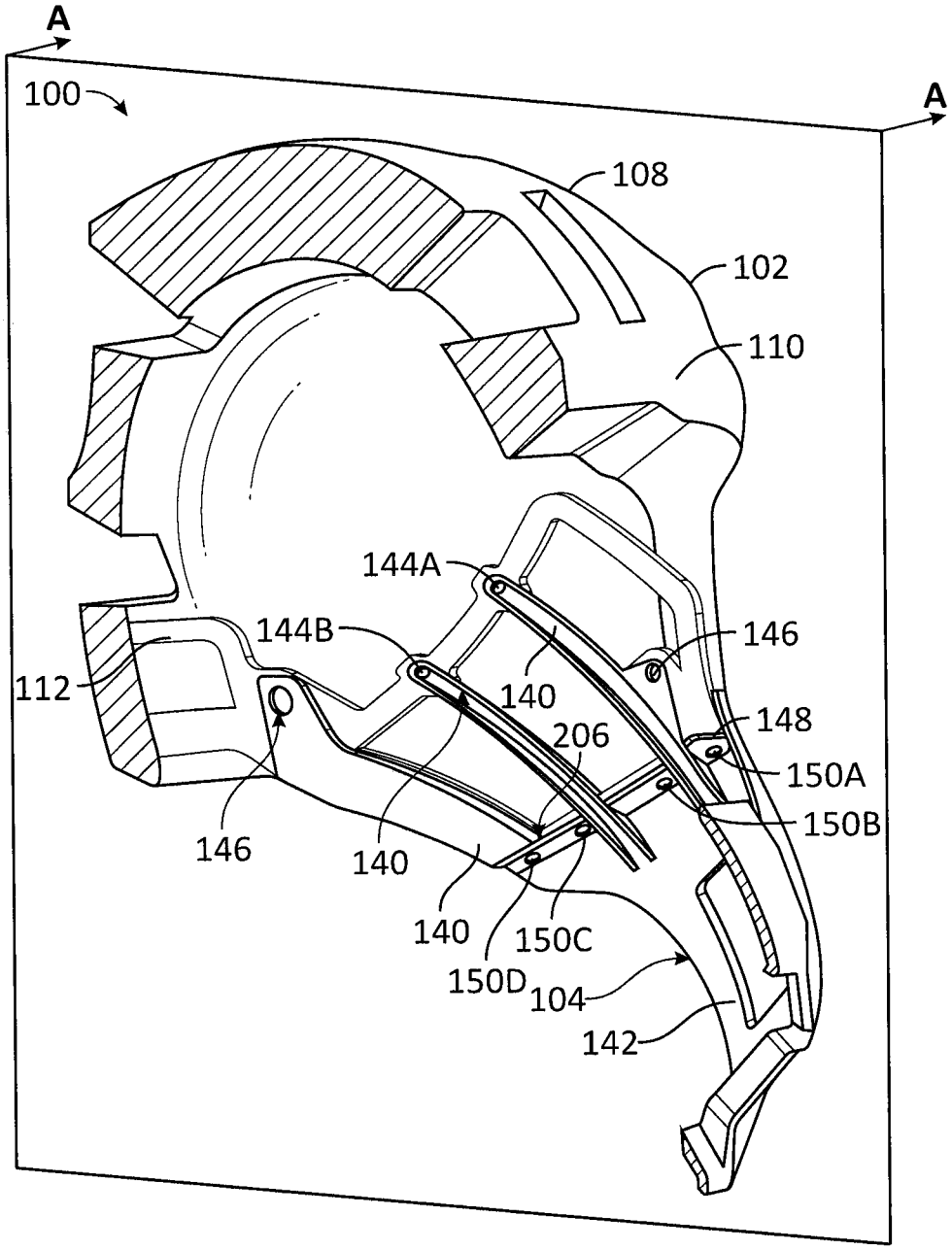
FIG. 4 shows a further perspective cross-sectional view of the helmet assembly of FIGS. 1A and 1B along section A-A with select portions of the helmet assembly removed for illustration purposes, in accordance with an embodiment.

FIG. 1B shows a front view of a helmet assembly, in accordance with an embodiment. Similar to FIG. 1A, FIG. 1B shows helmet assembly 100 including helmet 102 and chinbar 104. As shown in FIGS. 1A and 1B, chinbar 104 is coupled to helmet 102. Additionally, FIGS. 1A and 1B show reference directions. Directions 210 and 212 are right and left directions, respectively (right and left directions from the perspective of a wearer of helmet assembly 100). Directions 214 and 216 are top and bottom directions, respectively. Directions 218 and 220 are forward and rearward directions, respectively. Directions 210, 212, 214, 216, 218, and 220 may correspond with corresponding sides or portions of the helmet assembly 100. For example, directions 210 and 212 may correspond with right and left sides or portions of the helmet assembly 100, directions 214 and 216 may correspond with top and bottom sides or portions of the helmet assembly 100, and directions 218 and 220 may correspond with front/forward and rear/rearward sides or portions of the helmet assembly 100. FIG. 1B also shows a cutting plane for section A-A. FIGS. 2-4 illustrate various features of helmet assembly 100 through cross-sectional views along section A-A.

Figure 1C:
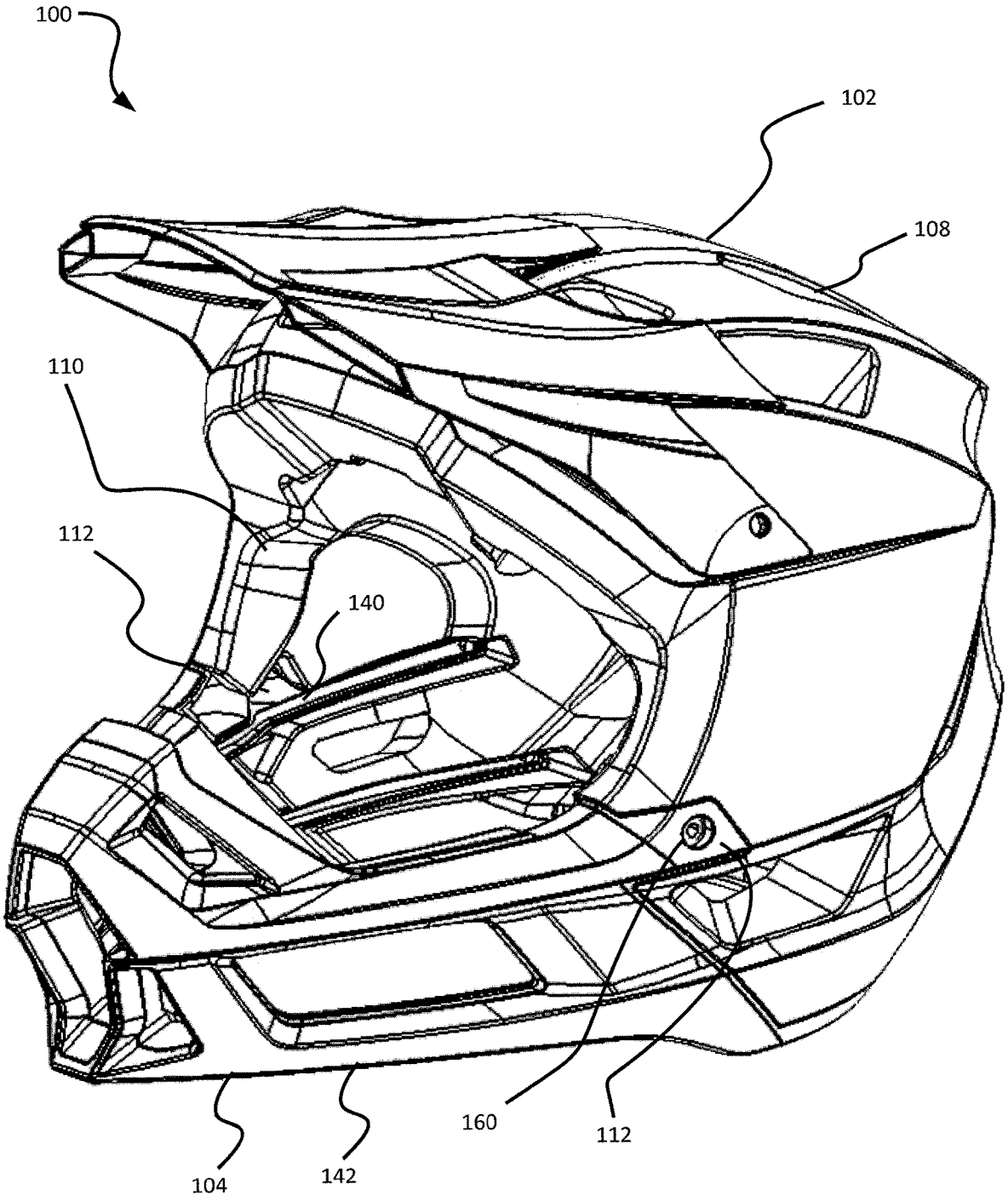
FIG. 1C shows a perspective side view of the helmet assembly of FIGS. 1A and 1B, in accordance with an embodiment.
Figure 1D:
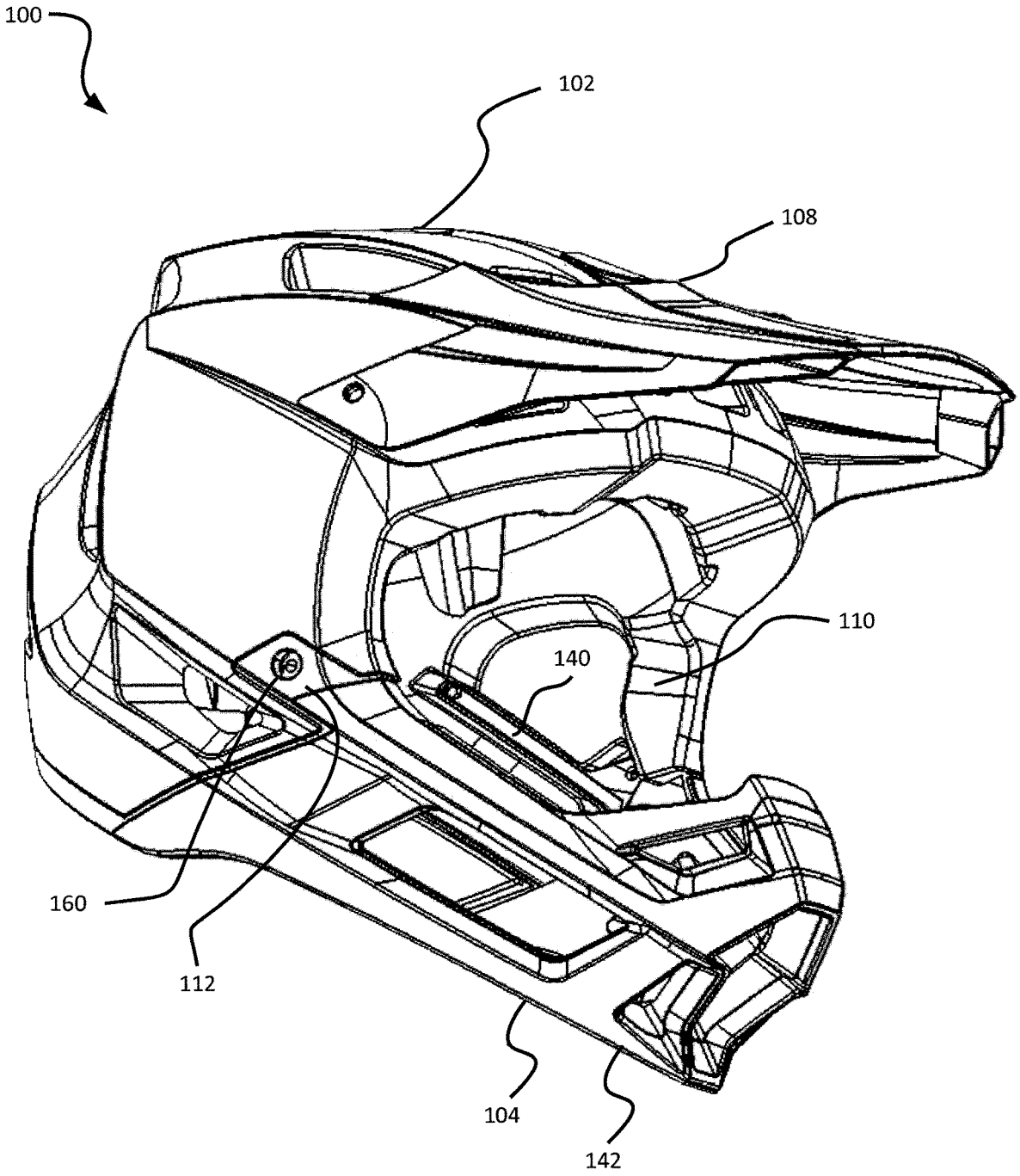
FIG. 1D shows another perspective side view of the helmet assembly of FIGS. 1A and 1B, in accordance with an embodiment.

FIG. 1C shows a perspective side view of the helmet assembly 100 of FIGS. 1A and 1B, in accordance with an embodiment. FIG. 1D shows another perspective side view of the helmet assembly 100 of FIGS. 1A and 1B, in accordance with an embodiment. FIGS. 1C and 1D show helmet assembly 100 that includes helmet 102 and chinbar 104. Helmet 102 includes outer shell 108, liner 110, and docking cage 112. Chinbar 104 may include outer portion 142 and an attachment portion that includes fingers 140. Chinbar 104 may be coupled to docking cage 112 via rivet 160. A portion of docking cage 112 may be disposed on an exterior side of helmet 102 and/or outer shell 108. Furthermore, another portion of docking cage 112 may be disposed on an interior side of helmet 102 and/or outer shell 108. Chinbar 104 may be coupled to docking cage 112 through one or more of the features described herein.

FIG. 2 shows a perspective cross-sectional view of the helmet assembly 100 of FIGS. 1A and 1B along section A-A, in accordance with an embodiment. FIG. 2 shows a cross-sectional view of helmet assembly 100 that includes helmet 102 and chinbar 104.

As shown in the cross-sectional view of FIG. 2, helmet 102 includes outer shell 108, liner 110, and docking cage 112. Outer shell 108 may be disposed on a first side 200 of liner 110 away from the side of liner 110 that receives a wearer's head. A second side 202 of liner 110 is configured to receive the wearer's head when helmet 102 is worn by the wearer. The second side 202 may be opposite that of the first side 200.

Docking cage 112 may be made from a material different from the material of liner 110. Thus, liner 110 may be made from a softer material configured primarily to absorb forces while docking cage 112 may be made from a material suitable for coupling to chinbar 104. In certain embodiments, the material of docking cage 112 may also be configured to absorb forces and provide cushion to the user. Docking cage 112 may be formed separately from liner 110 and assembled to liner 110, or may be formed together (e.g., co-molded) with liner 110.

Docking cage 112 may be coupled to liner 110. Docking cage 112 may be cage shaped and, in certain embodiments, all or at least a portion of docking cage 112 may be disposed on the second side 202 of liner 110 (e.g., posts 116A and 116B, also referred to as attachment posts, may be disposed on the second side 202 of liner 110 and in certain such embodiments, other portions of docking cage 112 may be disposed within liner 110 or on the first side 200 between liner 110 and outer shell 108). Additionally, in certain embodiments, docking cage 112 may be coupled (e.g., attached via mechanical fasteners such as snaps, rivets, bolts, posts, and/or interference fits or with adhesives or other techniques) to liner 110, such as on the second side 202 of liner 110. Additionally or alternatively, docking cage 112 may be coupled to outer shell 108 and/or another portion of helmet 102. Accordingly, in certain embodiments, all or portions of docking cage 112 may be disposed on the first side 200 of liner 110, second side 202 of liner 110, or within liner 110. Such embodiments may position portions of chinbar 104 (e.g., portions of chinbar 104 configured to couple to docking cage 112) on the first side 200 and/or second side 202 of liner 110 when chinbar 104 is coupled to docking cage 112.

Certain features of docking cage 112 (e.g., posts) may protrude through liner 110 to interact with chinbar 104. Such posts may interact with chinbar 104 to, for example, control the spatial relationship of (e.g., distance between) docking cage 112 to chinbar 104 and/or hold chinbar 104 relative to docking cage 112 and also, in certain embodiments, control spatial relationship of docking cage 112 relative to liner 110 and/or hold liner 110 to docking cage 112. Thus, the spatial relationship of chinbar 104 to liner 110 may be better controlled, improving helmet fit and increasing wearer comfort.

Disposing at least a portion of docking cage 112 on the second side 202 may allow for an attachment portion of chinbar 104, configured to couple to docking cage 112, to be also disposed on the second side 202 of liner 110 and thus within the interior of liner 110. Disposing the attachment portion of chinbar 104 on the second side 202 may allow for easier connection and disconnection of chinbar 104 to and from helmet 102.

Docking cage 112 may include docking frame 114, posts 116A and 116B, rivet holes 118A and 118B, docking frame datum 120, and posts 122A-D (also referred to as positioning posts). All or some of docking cage 112 may be molded (e.g., injection molded separately or with liner 110) or formed through another such technique (cast, machined, etc.). All or some of docking cage 112 may be formed from a flexible material that may be configured to deflect when subjected to req typical of that of an impact experienced by helmet assembly 100 or configured to deflect in response to deflection of liner 110. As some or all of docking cage 112 may be disposed on the second side 202 of liner 110, a flexible docking cage 112 may increase wearer comfort or allow for greater protection for the wearer.

Docking frame 114 may be cage shaped or shaped in another manner and configured to substantially conform to a portion of the second side of liner 110. Docking frame 114 may be a thin thickness to allow for a less bulky helmet and/or a thicker liner 110 to improve user protection. Docking frame 114 may be formed separate from other features of docking cage 112 (and such features may be added after forming of docking frame 114) or may be formed in the same process as that of other features of docking cage 112 (e.g., all features of docking cage 112 may be formed as one injection molded part).

Posts 116A, 116B, and/or 122A-D may be configured to receive corresponding openings or apertures of chinbar 104 to position chinbar 104 relative to docking cage 112. In the embodiment shown in FIG. 2, posts 116A and 116B may position chinbar 104 substantially along one direction (e.g., substantially along directions 218/220 and/or directions 214/216) while posts 122A-D may position chinbar 104 substantially along another direction (e.g., substantially along directions 210/212).

Furthermore, docking frame datum 120 may also position chinbar 104 substantially along a direction (e.g., substantially along directions 218/220) to further position chinbar 104 relative to docking cage 112. Chinbar 104 may be positioned on side 204 of docking frame datum 120 by, for example, resting chinbar 104 against side 204 of docking frame datum 120. All or the majority of a wearer's head may be positioned on side 206 of docking frame datum 120 when helmet 102 is worn by the wearer.

Rivet holes 118A and 118B are configured to receive a rivet. Rivets may pass through corresponding openings in chinbar 104 and, thus, couple chinbar 104 to docking cage 112. Such rivets may include permanent or removable plastic and/or metal rivets and/or other fasteners such as posts, snaps, threaded fasteners, Velcro, adhesives, press fits, and/or other techniques to couple chinbar 104 to docking cage 112.

FIG. 3 shows another perspective cross-sectional view of the helmet assembly 100 of FIGS. 1A and 1B along section A-A, in accordance with an embodiment. FIG. 3 may illustrate features of liner 110 of helmet 102. Liner 110 may include channels 130. Channels 130 may be configured to receive a portion of chinbar 104. Channels 130 may be configured to further position chinbar 104 relative to helmet 102. For example, as shown in FIG. 4, chinbar 104 may include fingers 140 configured to extend into channels 130. Additionally, at least a portion of docking cage 112 may also be disposed within channels 130. Thus, for example, posts 116A and 116B may be disposed within channels 130. Disposing posts 116A and 116B (and/or other parts of docking cage 112 and/or chinbar 104 such as rivets) within channels 130 may increase wearer comfort as the raised posts and/or other components may be positioned within channels 130 to not contact the wearer when helmet 102 is worn by the wearer.

FIG. 4 shows a further perspective cross-sectional view of the helmet assembly 100 of FIGS. 1A and 1B along section A-A, in accordance with an embodiment. FIG. 4 may better illustrate features of chinbar 104. Chinbar 104 may include outer portion 142 and an attachment portion that includes fingers 140 and chinbar datum 148.

Outer portion 142 may be a portion of chinbar 104 substantially forward of datum 148 (e.g., may extend forward substantially in direction 218). Outer portion 142 may, when chinbar 104 is coupled to helmet 102, provide protection to a lower portion of a wearer's face (e.g., the wearer's mouth, chin, jaw, nose, or a portion thereof of one or more of the mouth, chin, jaw, and nose). In certain embodiments, in contrast to the attachment portion, outer portion 142 may not be disposed within helmet 102 when chinbar 104 is coupled to helmet 102.

When chinbar 104 is coupled to helmet 102, the attachment portion may be disposed within helmet 102. As such, when attachment portion is coupled to helmet 102, as shown in FIG. 4, the attachment portion may be disposed, fully or partially, on second side 202 of the liner 110.

The attachment portion may include fingers 140 and may position chinbar 104 relative to docking cage 112 as well as couple to docking cage 112. Fingers 140 may be configured to couple to docking cage 112. For example, one or more fingers 140 may be configured to be inserted into one or more channels 130. As such, fingers 140 may be shaped to be inserted into channels 130 (e.g., may be a shape that substantially conforms or may be received within channel 130). In certain embodiments, fingers 140 may be shaped to contact one or more walls of channels 130 to further position chinbar 104 relative to helmet 102. Furthermore, fingers 140 and/or channels 130 may be shaped to guide insertion of fingers 140 into channels 130 along a certain path. While embodiments described herein include fingers 140 as part of the attachment portion of chinbar 104, other embodiments may not include fingers and may, for example, include a continuous flange of material extending from chinbar 104 as the attachment portion.

Referring back to fingers 140, fingers 140 may include openings 144A and 144B and rivet holes 146. When chinbar 104 is coupled to docking cage 112, rivet holes 146 may be positioned proximate to rivet holes 118A and 118B. A rivet and/or other fastener may be inserted through rivet holes 118A and 118B and the respective rivet holes 146 to hold chinbar 104 to docking cage 112. In certain embodiments, a wearer may thus position chinbar 104 proximate to docking cage 112 and may then insert rivets and/or other fasteners through rivet holes 118A and 118B and the respective rivet holes 146 to couple chinbar 104 to docking cage 112.

In certain other embodiments, the fastener may be disposed or coupled to one or the other of docking cage 112 or the attachment portion. Thus, docking cage 112 or the attachment portion may, for example, include one or more snap features that can be inserted through a corresponding opening on the other of docking cage 112 or the attachment portion to couple chinbar 104 to docking cage 112.

Openings 144A and 144B may be configured to receive posts 116A and 116B (e.g., posts 116A and 116B may be inserted into openings 144A and 144B, respectively) of docking cage 112 to hold chinbar 104 relative to docking cage 112. Furthermore, chinbar datum 148 may include openings 150A-D. Openings 150A-D may be configured to receive posts 122A-D, respectively (e.g., posts 122A-D may be inserted into openings 150A-D). Chinbar datum 148 may be configured to abut side 204 of docking frame datum 120. When chinbar datum 148 abuts side 204 of docking frame datum 120, posts 122A-D are inserted into openings 150A-D, and posts 116A and 116B are inserted into openings 144A and 144B. Chinbar 104 may then accordingly be positioned relative to docking cage 112 so that rivets may be inserted through rivet holes 118A and 118B and respective rivet holes 146 to secure chinbar 104 to docking cage 112.

In other embodiments, chinbar 104 may include any number of openings, posts, datums, and/or other features to position chinbar 104 to docking cage 112. In the embodiment shown, fingers 140 may first be inserted into channels 130 to broadly position chinbar 104 to docking cage 112 while the openings, posts, and datums may then more precisely position chinbar 104 relative to docking cage 112.

Figure 5A:
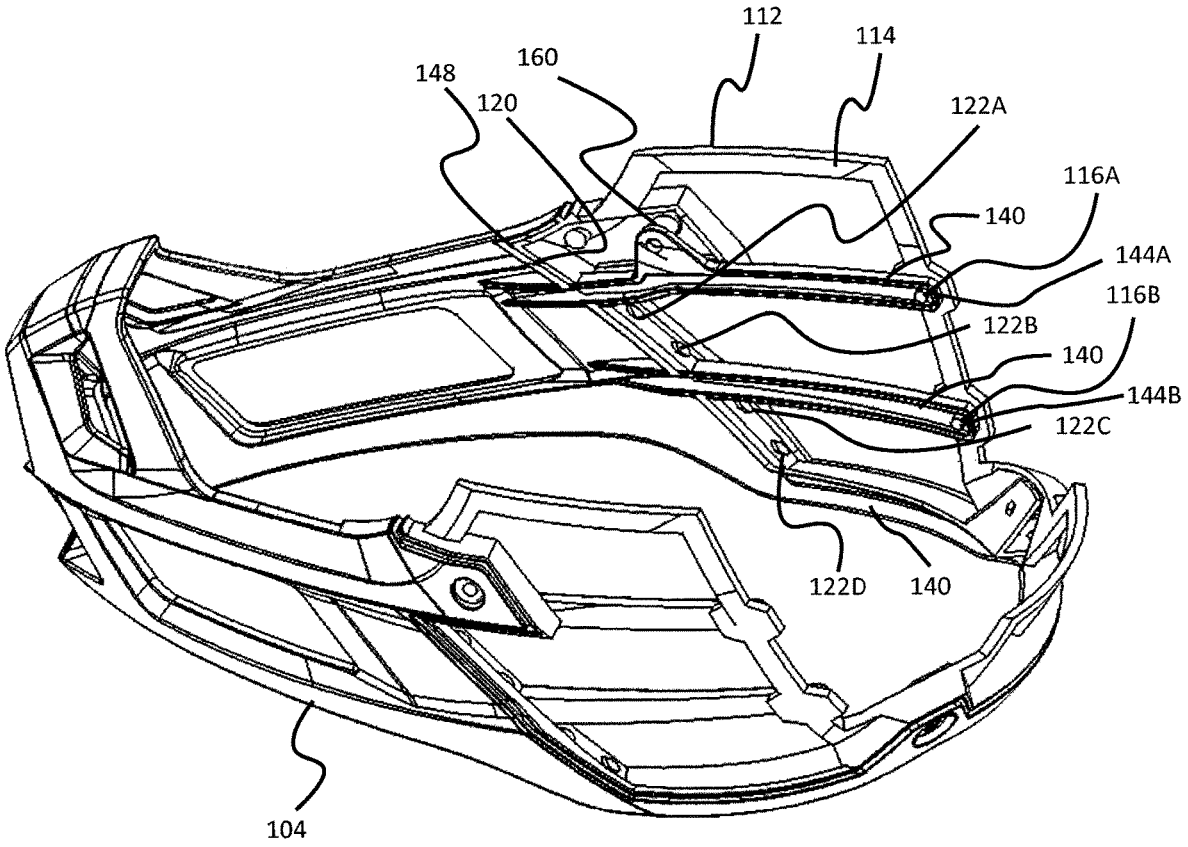
FIG. 5A shows a perspective view of a chinbar and docking cage, in accordance with an embodiment.

FIG. 5A shows a perspective view of a chinbar and docking cage, in accordance with an embodiment. FIG. 5A shows chinbar 104 coupled to docking cage 112. As shown in FIG. 5A, posts 116A and 116B of docking cage 112 are inserted into openings 144A and 144B and posts 122A-D are inserted into openings 150A-D (not shown in FIG. 5A for the sake of clarity, but shown in FIG. 4). Datum 148 of chinbar 104 may contact datum 120 of docking cage 112. Insertion of posts into corresponding openings, as well as positioning of datums relative to one another allows for positioning of chinbar 104 to docking cage 112. Chinbar 104 may then be coupled to docking cage 112 via rivets 160.

Figure 5B:
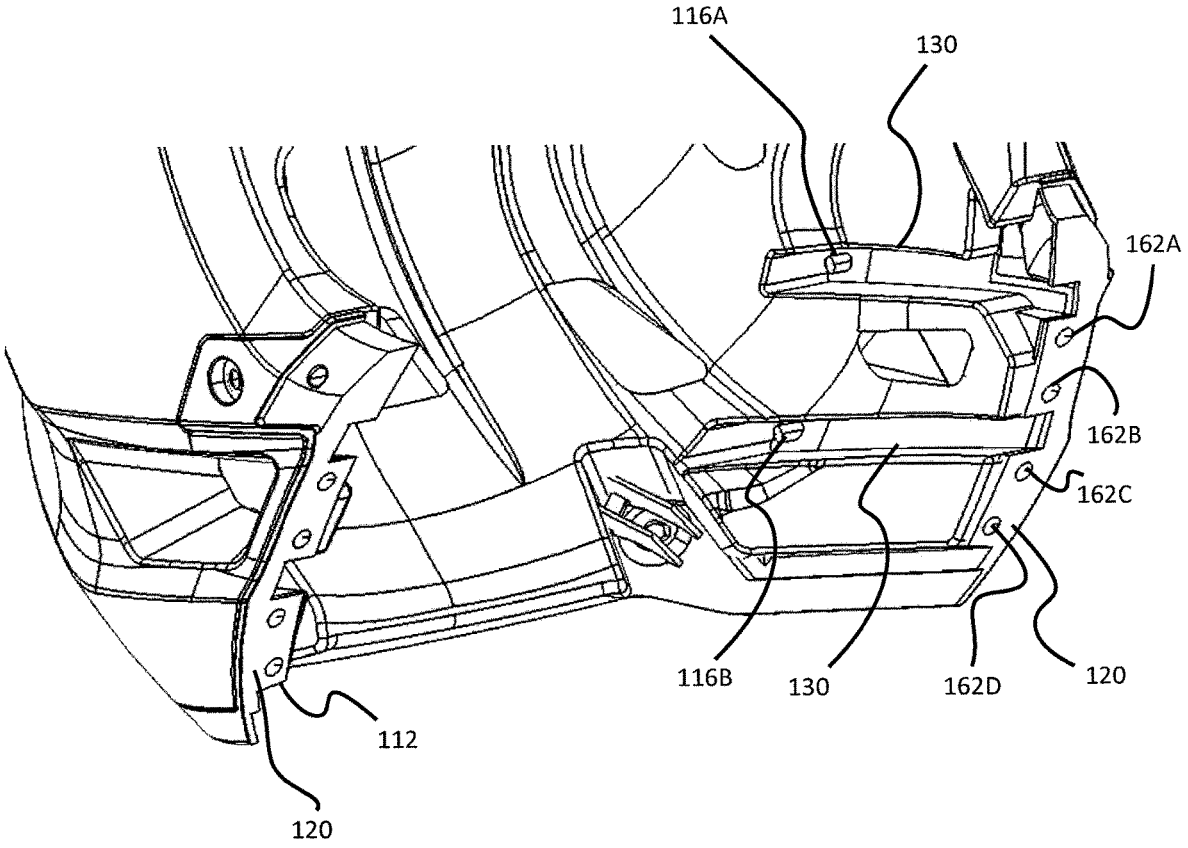
FIG. 5B shows a view of a helmet, in accordance with an embodiment.

FIG. 5B shows a view of a helmet, in accordance with an embodiment. FIG. 5B further illustrates posts 116A and 116B, openings 162A-D, and datums 120 of docking cage 112. In the embodiment shown in FIG. 5B, docking cage 112 may include openings 162A-D instead of posts 122A-D. Thus, the chinbar configured to couple to docking cage 112 may instead include posts for insertion into openings 162A-D. Outer shell 108 may also include openings that correspond to openings 162A-D so that a post of the chinbar can extend into an opening of the docking cage 112 and then further into an opening of the outer shell 108. Further, as shown in FIG. 5B, portions of docking cage 112, such as posts 116A and 116B, may be disposed within channels 130. Portions of the chinbar may also be disposed within channels 130.

While portions of docking cage 112 may be disposed within channels 130 interior of outer shell 108, other portions of docking cage 112 may be disposed exterior to docking cage 112. Such a configuration allows for docking cage 112 to be more securely and accurately positioned relative to outer shell 108. A docking cage 112 separate from outer shell 108 may allow for better positioning of chinbar 104 and better distribution of forces (e.g., impact forces) experienced by chinbar 104. Furthermore, docking cage 112 can allow for tighter tolerances for features that interact with chinbar 104, improving fit of finish of the helmet assembly. In certain embodiments, chinbar 104 may couple to both docking cage 112 and outer shell 108. Such a configuration may allow for more secure mounting of chinbar 104 to outer shell and better positioning of chinbar 104 and/or docking cage 112 relative to outer shell 108.

Figure 5C:
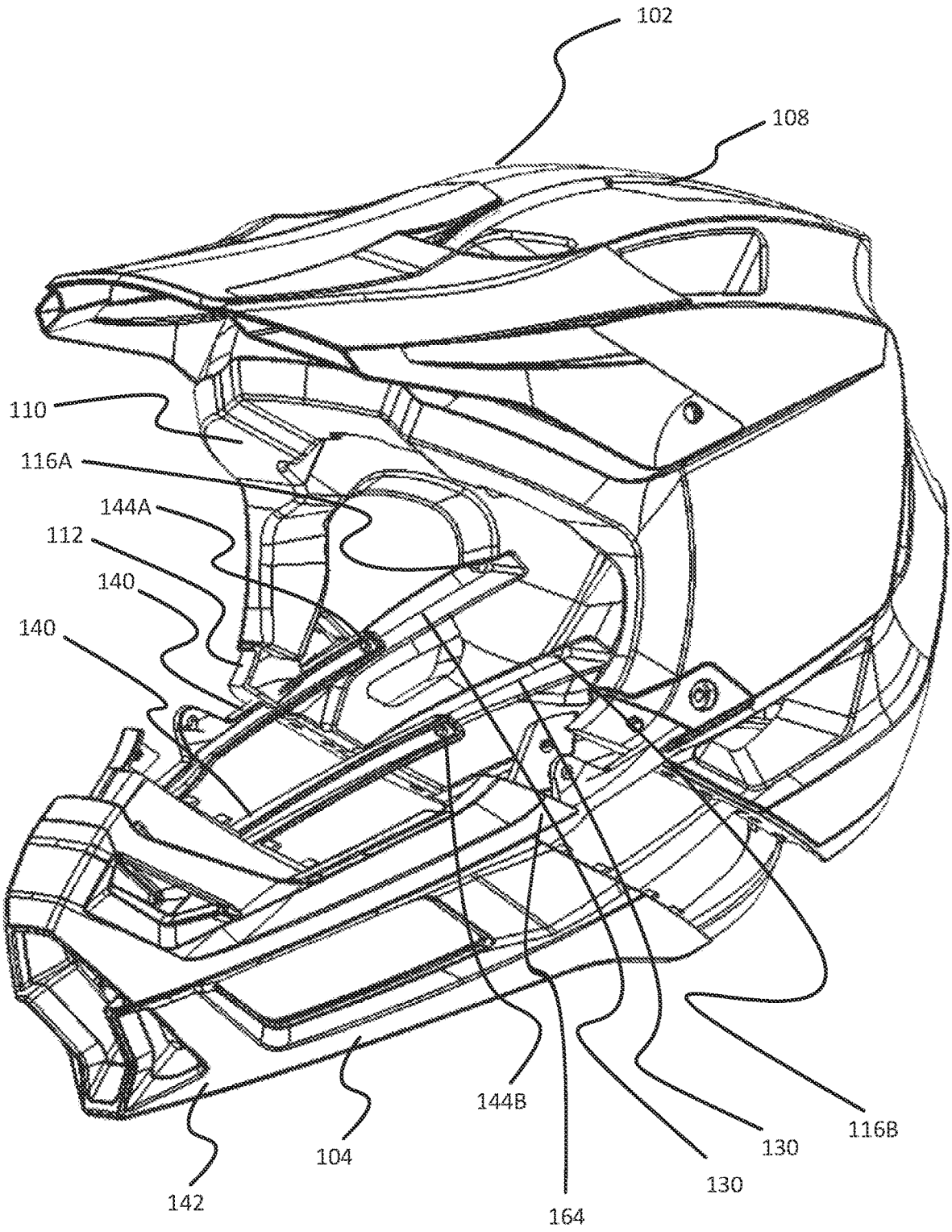
FIG. 5C shows a perspective view of the helmet assembly of FIG. 1A with the chinbar decoupled, in accordance with an embodiment.

FIG. 5C shows a perspective view of the helmet assembly 100 of FIG. 1A with the chinbar 104 decoupled, in accordance with an embodiment. As shown in FIG. 5C, chinbar 104 may be in the process of assembling with helmet 102. Fingers 140 of chinbar 104 may thus be disposed within channels 130. Channels 130 may thus aid in positioning of chinbar 104 relative to docking cage 112, outer shell 108, and/or helmet 102. Thus, certain features of one component (e.g., liner 110) of the helmet assembly 100 may aid in positioning another component (e.g., chinbar 104) relative to a further component (e.g., docking cage 112) and, accordingly, increase fit and finish, increase ease of assembly, or decrease parts count.

Figure 5D:
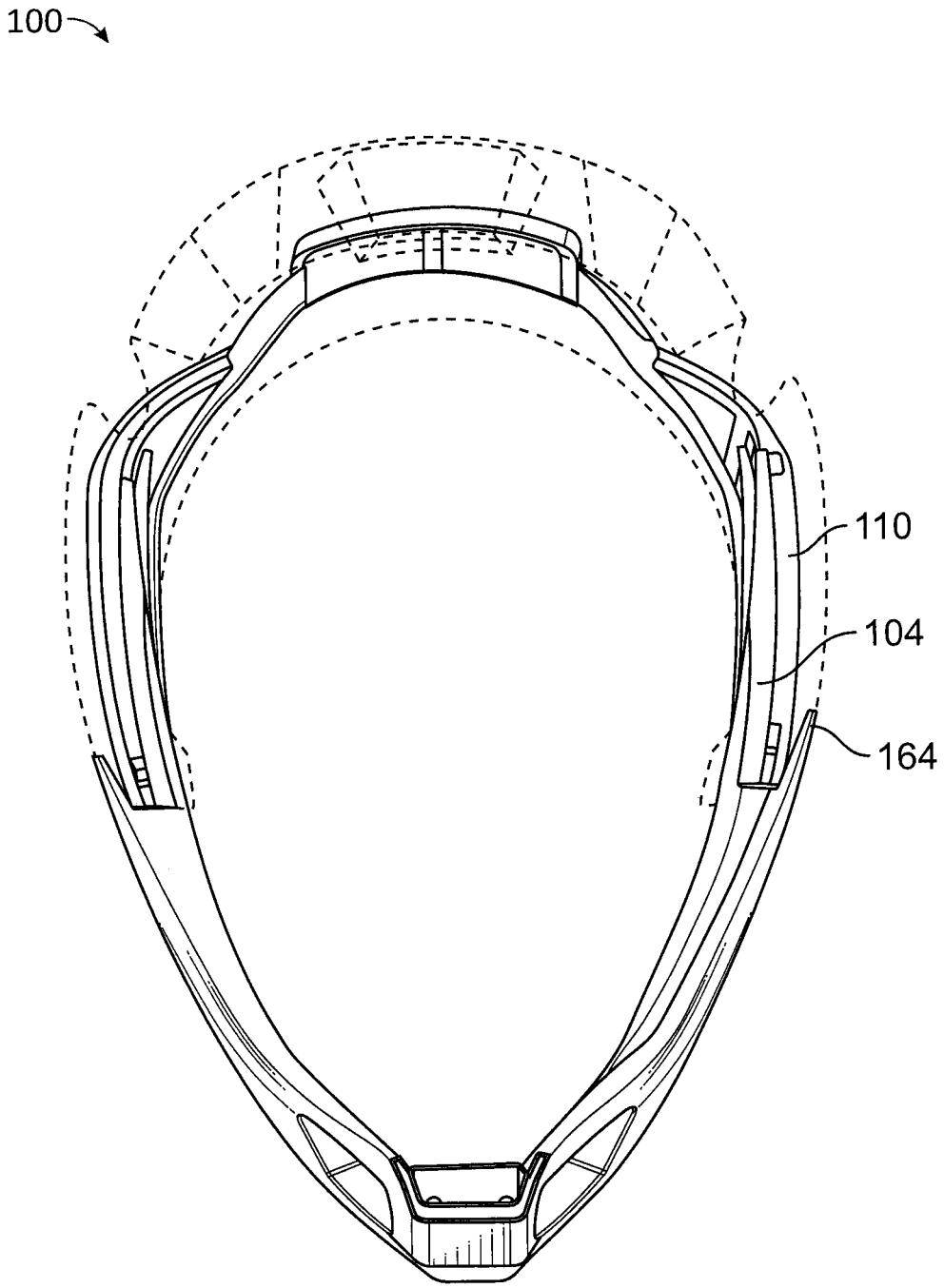
FIG. 5D shows a top cross-sectional view of the helmet assembly of FIGS. 1A and 1B, in accordance with an embodiment.

FIG. 5D shows a top cross-sectional view of the helmet assembly 100 of FIGS. 1A and 1B, in accordance with an embodiment. FIG. 5D may show chinbar 104 disposed relative to liner 110 and docking cage 112 (not clearly shown) so that chinbar 104 may be coupled to docking cage 112. Chinbar 104 may further include flange 164 configured to be disposed on the first side 200 of liner 110, in contrast to the majority of chinbar 104 which may be disposed on the second side 202 of liner 110, when chinbar 104 is coupled to docking cage 112. Flange 164 may aid in positioning of chinbar 104 relative to docking cage 112 and/or liner 110.

Figure 6:
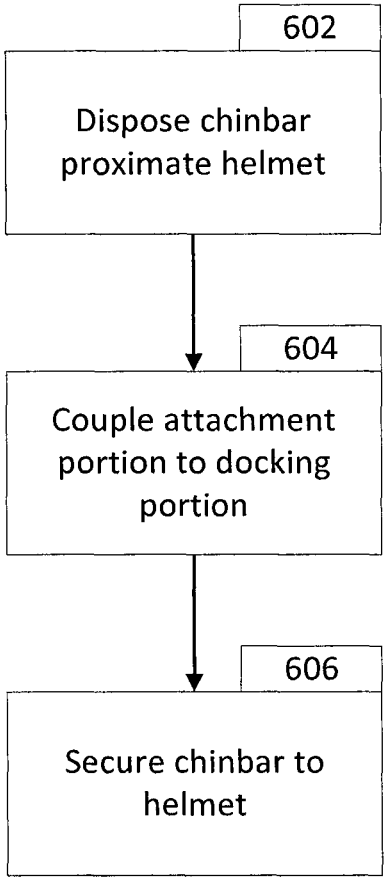
FIG. 6 shows a flowchart detailing a process for attaching a chinbar to a helmet, in accordance with an embodiment.

FIG. 6 shows a flowchart detailing a process for attaching a chinbar (e.g., chinbar 104) to a helmet (e.g., helmet 102), in accordance with an embodiment. Prior to block 602, the chinbar 104 and the helmet 102 may be separate (e.g., not coupled or attached). In block 602, the chinbar 104 may be disposed proximate to the helmet 102. That is, the attachment portion may be inserted within the helmet 102. In block 602, one or more fingers 140 may be inserted into one or more channels 130. The channels 130 may guide further insertion of the fingers 140 and thus may help position the chinbar 104 relative to the helmet 102.

In block 604, the attachment portion may be coupled to a docking portion, such as the docking frame 114. The attachment portion and the docking frame 114 may include formed shapes and corresponding openings, respectively (e.g., posts and corresponding holes as well as forms of other geometric shapes such as depressions and forms configured to interface with the depressions that are configured to position the chinbar relative to the helmet), datums, attachment mechanisms (e.g., snaps or clips or other features that may, when the chinbar 104 is positioned proximate to the helmet 102, pull the chinbar 104 towards the helmet 102), and/or other features that may couple to each other.

Once the attachment portion is coupled to the docking frame 114, the chinbar 104 may be secured to the helmet 102 in block 606. Thus, one or more of mechanical fasteners (e.g., through rivets, bolts, Velcro, or other mechanical fasteners), adhesives, friction fits, or other techniques may couple the chinbar 104 to the helmet 102. Accordingly, the chinbar 104 may then be coupled to the helmet 102.

Figure 7:
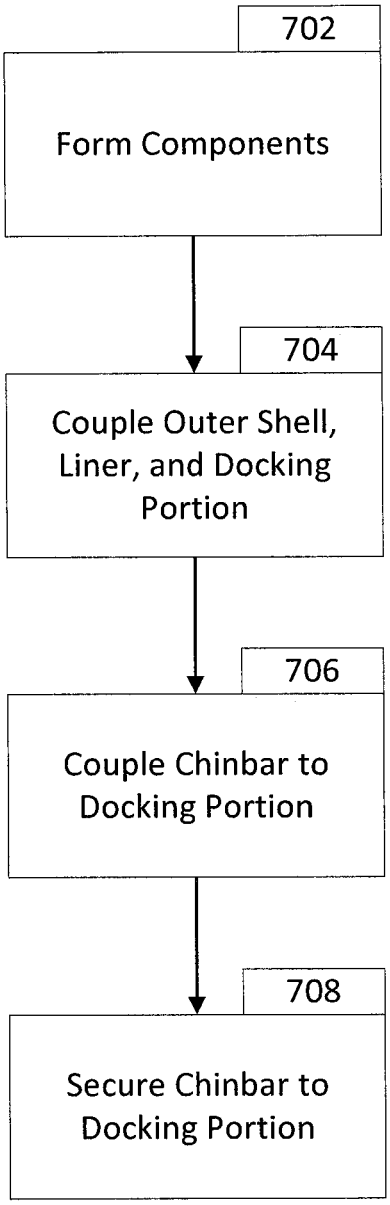
FIG. 7 shows a flowchart detailing a process for manufacturing of a helmet assembly, in accordance with an embodiment.

FIG. 7 shows a flowchart detailing a process for manufacturing of a helmet assembly, such as the helmet assembly 100 of FIGS. 1A and 1B, in accordance with an embodiment. In block 702, various components of the helmet assembly 100 (e.g., outer shell 108, liner 110, docking frame 114, chinbar 104, and/or other components) may be formed through one or more manufacturing techniques such as molding (e.g., injection molding), machining, casting, layup, or other manufacturing techniques.

In block 704, the various components may be assembled into the helmet 102 and the chinbar 104. As such, for example, the outer shell 108, liner 110, and docking frame 114, as well as possibly other components, may be assembled together to form the helmet 102. Components of the chinbar 104 may also be assembled together to form the complete chinbar 104.

In block 706, the chinbar 104 may be coupled to the docking frame 114. Coupling of the chinbar 104 to the docking frame 114 in block 706 may be similar to that described in blocks 602 and 604 of FIG. 6. In block 708, the chinbar 104 may then be secured to the helmet 102, through techniques similar to that described in block 606.

Figure 8:
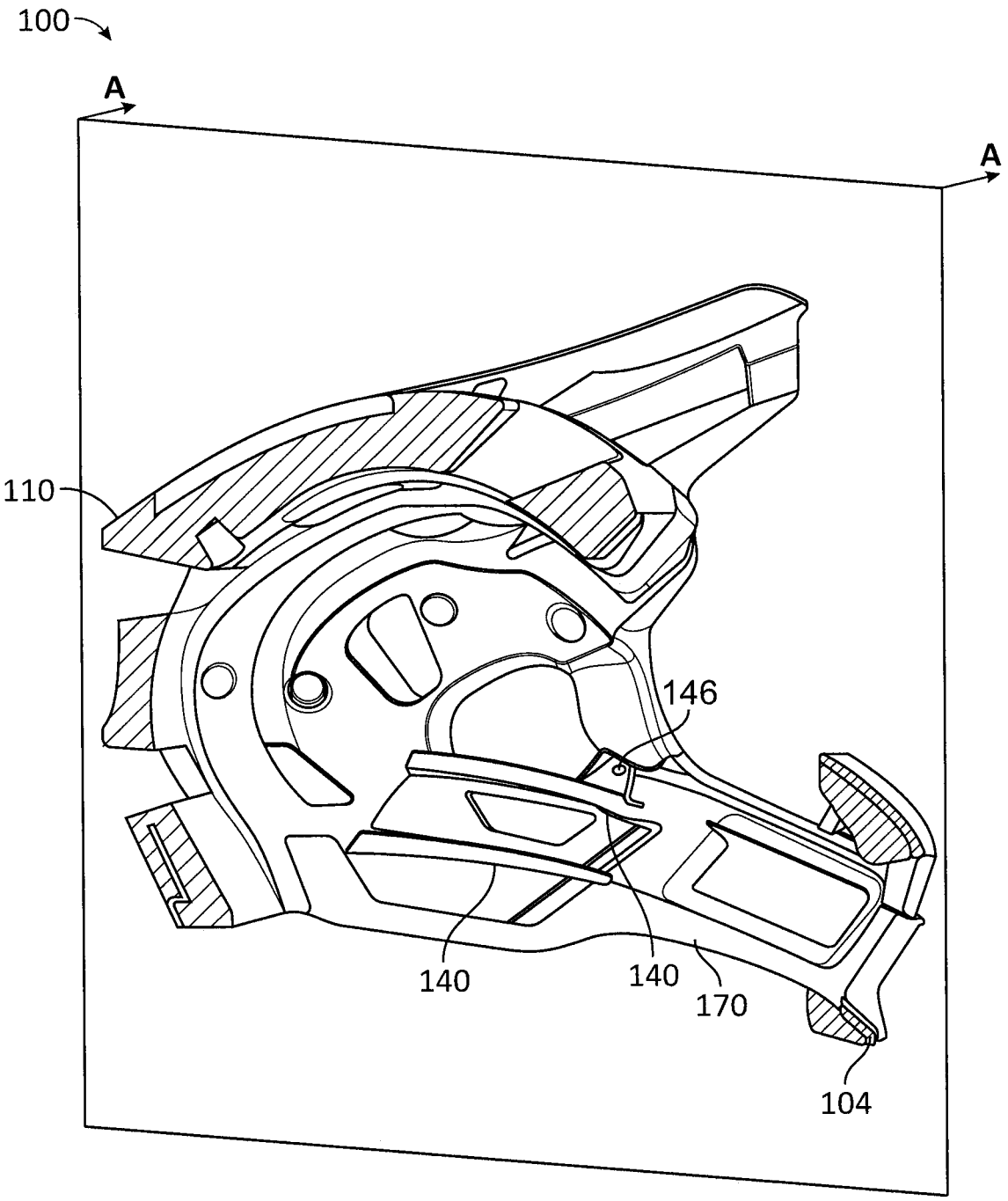
FIGS. 8-9 show perspective cross-sectional views of helmet assemblies along section A-A, in accordance with certain embodiments.
Figure 9:
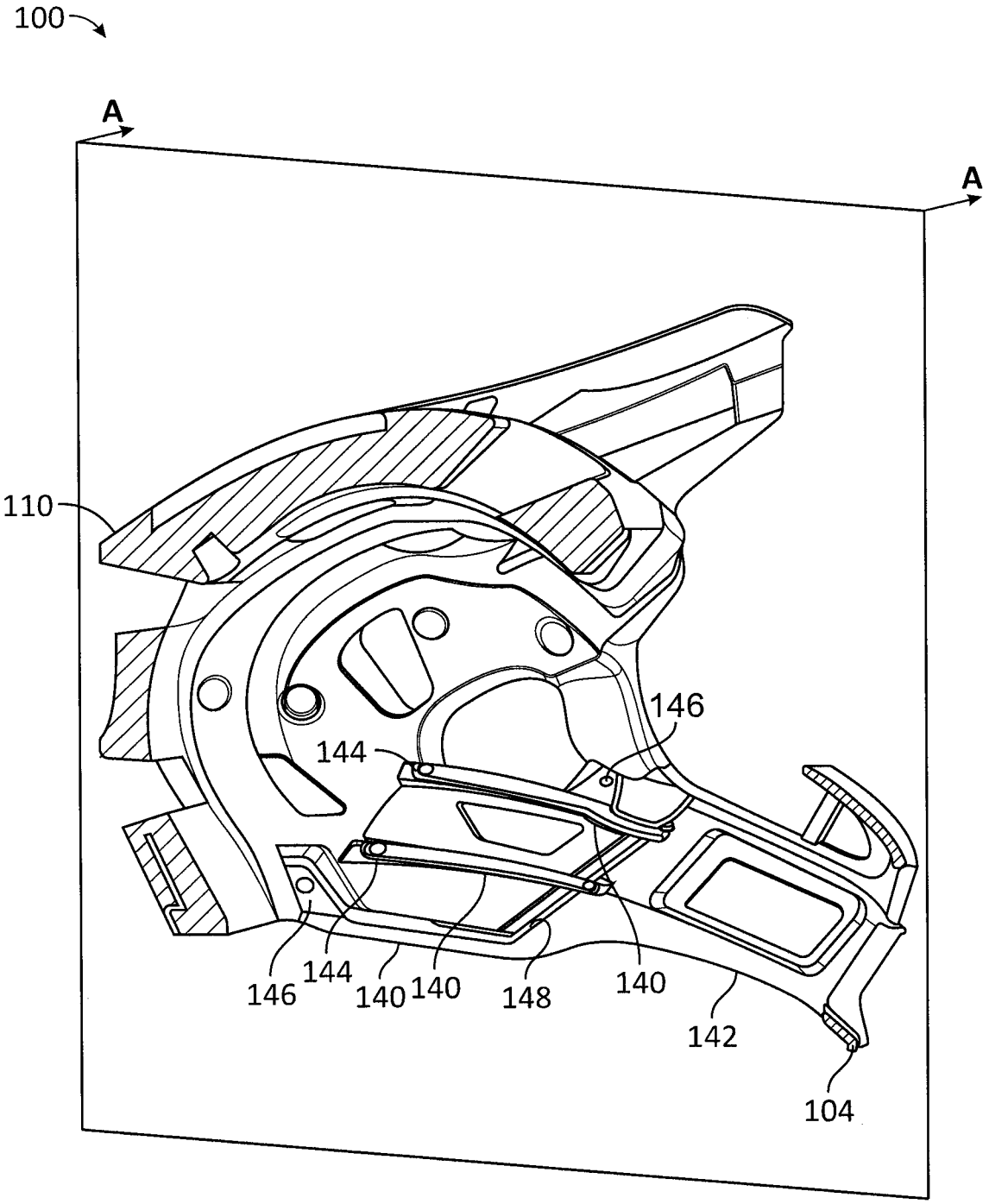

FIGS. 8-9 show perspective cross-sectional views of helmet assemblies 100 along section A-A, in accordance with certain embodiments. In FIGS. 8-9, helmet assembly 100 includes chinbar 104 and liner 110. In certain embodiments, chinbar 104 may be coupled to docking frame 114 (not shown in FIGS. 8 and 9) via, for example, fasteners disposed through openings 144 of fingers 140 and/or fasteners disposed through rivet hole 146. Further, chinbar datum 148 of chinbar 104 may abut side 204 of docking frame datum 120 of docking frame 114 (not shown).

In FIG. 8, padding 170 may be coupled to chinbar 104. In certain embodiments, padding 170 may be, for example, molded to chinbar 104 or may be separate padding coupled to chinbar 104. In certain such embodiments, the chinbar 104 may be coupled to the docking frame 114 and the padding 170 may then be molded over the chinbar 104. In other embodiments, the chinbar 104 may be coupled to the docking frame 114 and the padding 170 then accordingly disposed over the chinbar 104. In certain embodiments, the padding 170 may be removable to allow access to fasteners coupling the chinbar 104 to the docking frame 114, but other embodiments may permanently or semi-permanently couple the padding 170 to the chinbar 104.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed as new and desired to be protected is:

1. A helmet assembly comprising:

a chinbar comprising an attachment portion; and a helmet comprising:

an outer shell;

a liner coupled to the outer shell on a first side and configured to receive a user's head on a second side; and a docking frame coupled to the liner and configured to receive the attachment portion to couple the helmet to the chinbar;

wherein the liner comprises a channel, at least a portion of the docking frame is disposed within the channel, and the attachment portion comprises a finger configured to extend into the channel to couple to the docking frame.

2. The helmet assembly of claim 1, wherein the docking frame is coupled to the liner on the second side.

3. The helmet assembly of claim 1, wherein the docking frame comprises an attachment post disposed within the channel and wherein the finger comprises an opening configured to couple to the attachment post.

4. The helmet assembly of claim 1, wherein the docking frame comprises a positioning post disposed in a substantially forward facing position, and wherein the chinbar comprises an opening configured to couple to the positioning post.

5. The helmet assembly of claim 1, wherein the docking frame comprises a molded cage.

6. The helmet assembly of claim 1, further comprising a rivet coupling the attachment portion to the docking frame.

7. The helmet assembly of claim 1, wherein the chinbar further comprises a flange configured to be disposed on a first side of the outer shell, wherein the liner is coupled to the outer shell on a second side of the outer shell.

8. The helmet assembly of claim 1, wherein the liner is disposed between the outer shell and at least a portion of the docking frame.

9. The helmet assembly of claim 1, further comprising padding disposed over at least a portion of the chinbar.

10. A method of using the helmet assembly of claim 1, the method comprising:

disposing at least a portion of the attachment portion proximate the docking frame; and coupling the attachment portion to the docking frame.

11. The method of claim 10, wherein the coupling the attachment portion to the docking frame comprises riveting the attachment portion to the docking frame.

12. A helmet comprising:

an outer shell;

a liner coupled to the outer shell on a first side and configured to receive a user's head on a second side; and a docking frame coupled to the liner and configured to receive an attachment portion of a chinbar to couple the helmet to the chinbar;

wherein the liner comprises a channel configured to receive the attachment portion of the chinbar.

13. The helmet of claim 12, wherein the docking frame is coupled to the liner on the second side.

14. The helmet of claim 12, wherein at least a portion of the docking frame is disposed within the channel.

15. The helmet of claim 12, wherein the docking frame comprises an attachment post disposed within the channel configured to receive an opening of the attachment portion of the chinbar.

16. The helmet of claim 12, wherein the docking frame comprises a positioning post disposed in a substantially forward facing position and configured to couple to a chinbar.

17. The helmet of claim 12, wherein the docking frame comprises a molded cage.

18. The helmet of claim 12, wherein the liner is disposed between the outer shell and at least a portion of the docking frame.

19. A helmet assembly comprising:

a chinbar comprising an attachment portion; and a helmet comprising:

an outer shell;

a liner coupled to the outer shell on a first side and configured to receive a user's head on a second side; and a docking frame coupled to the liner and configured to receive the attachment portion to couple the helmet to the chinbar;

wherein the docking frame comprises a positioning post disposed in a substantially forward facing position, and the chinbar comprises an opening configured to couple to the positioning post.

20. A helmet assembly comprising:

a chinbar comprising an attachment portion; and a helmet comprising:

an outer shell;

a liner coupled to the outer shell on a first side and configured to receive a user's head on a second side;

a docking frame coupled to the liner and configured to receive the attachment portion to couple the helmet to the chinbar; and a rivet coupling the attachment portion to the docking frame.

21. A helmet assembly comprising:

a chinbar comprising an attachment portion; and a helmet comprising:

an outer shell;

a liner coupled to the outer shell on a first side and configured to receive a user's head on a second side; and a docking frame coupled to the liner and configured to receive the attachment portion to couple the helmet to the chinbar;

wherein the chinbar further comprises a flange configured to be disposed on a first side of the outer shell, and the liner is coupled to the outer shell on a second side of the outer shell.

22. A method of using a helmet assembly, the method comprising:

disposing at least a portion of an attachment portion of a chinbar proximate a docking frame of a helmet, wherein the helmet comprises an outer shell and a liner coupled to the outer shell on a first side and configured to receive a user's head on a second side; and coupling the attachment portion to the docking frame by riveting the attachment portion to the docking frame.

23. A helmet comprising:

an outer shell;

a liner coupled to the outer shell on a first side and configured to receive a user's head on a second side; and a docking frame coupled to the liner and configured to receive an attachment portion of a chinbar to couple the helmet to the chinbar;

wherein the docking frame comprises a positioning post disposed in a substantially forward facing position and configured to couple to the chinbar.

* * * * *